United States Patent [19]

Kapadia et al.

[11] 4,303,812

[45] Dec. 1, 1981

[54] SELF-LOCKING SWITCH CONTACT MEMBER

[75] Inventors: Uday S. Kapadia, Elizabeth; John W. Logioco, Middletown, both of N.J.

[73] Assignee: Bell Telephone Laboratories, Incorporated, Murray Hill, N.J.

[21] Appl. No.: 108,668

[22] Filed: Dec. 31, 1979

[51] Int. Cl.[3] ..... H01H 19/00

[52] U.S. Cl. ..... 200/6 R; 179/158 R; 179/175.1 R; 200/243; 200/340

[58] Field of Search ..... 200/6 BA, 6 R, 6 BB, 200/6 C, 292, 295, 283, 243, 335, 340, 159 R, 159 A, 159 B; 179/98, 158 R, 1 SW, 175.1 R; 361/400, 401; 339/19, 149 P, 150 B

[56] References Cited

U.S. PATENT DOCUMENTS 2,229,585 1/1941 Osenberg ..... 200/6 BA 4,052,579 10/1977 Arthur ..... 200/283

4,057,520 11/1977 Schwartz ..... 200/295

*Primary Examiner*—James R. Scott

*Assistant Examiner*—Morris Ginsburg

*Attorney, Agent, or Firm*—John A. Caccuro

[57] ABSTRACT

The disclosed one piece self-locking switch contact member is arranged to mount on the handle of a printed circuit board. The switch member functions as a movable switch contact which is operable from the user's finger pressure to electrically connect together two test terminals located in an aperture of the handle. The switch member is made of a resilient dielectric material having an open loop end arranged for a snap-on lock mounting between the aperture and an edge of the handle. The other end of the switch member contains an electrical contact area and is cantilevered by the mounting to provide a resilient movement which permits contact with the test terminals when acted upon by finger pressure.

8 Claims, 3 Drawing Figures

SELF-LOCKING SWITCH CONTACT MEMBER

TECHNICAL FIELD

This invention relates to a momentary switch contact member mountable on a handle of a key telephone printed wiring board.

BACKGROUND OF THE INVENTION

In key telephone systems the line control boards have handles positioned along the edge opposite the terminals for the purpose of providing gripping surfaces for removing the printed wiring boards from the network. Typically, the handles are provided with apertures containing electrical terminals which can be interconnected in various combinations to provide different operational or test characteristics for the associated line circuit.

The −48 volt line test function on an existing type of line circuit currently requires the craftsperson to insert the blade of a small screwdriver into an aperture of the handle to provide a short between two test terminals. Such a testing arrangement has the drawback that a possible shock hazard may exist if the test is performed by an unskilled person.

Thus, it is desired to design a test arrangement which would eliminate any possible shock hazard when the test function is performed by an unskilled person. Moreover, it is desired that any circuit additions or modifications required to implement the test function be minimized and economically adaptable to existing key telephone line circuits.

SUMMARY OF THE INVENTION

A momentary test function switch is implemented using a one piece resilient dielectric switch contact member having an open loop end which is self-locking around an aperture and an edge of the handle. The other end, having a metal contact on its tip, is cantilevered about this mounting and is free to resiliently move in response to external finger pressure. When pressed, the conductive tip of the cantilevered end resiliently deflects to make contact with the test terminals within the aperture in the handle. When pressure is released the cantilevered end resumes its original no contact position. Thus, the resilient characteristic of the material used to make the disclosed switch contact member is utilized to perform the locking and self-restoring functions.

The switch contact member is installed by deflecting a locking tab on the tip of the open loop end of the switch member such that the open loop can slide over the edge of the handle and lock into the aperture of the handle. Removal of the switch contact member is achieved by deflecting the locking tab out of the aperture and sliding the switch member back toward the edge of the handle.

Accordingly, it is a feature of our invention to provide a one piece resilient dielectric switch contact member having an open loop end for snap-on self-locking to a mounting board between a slot therein and an edge of the board, and a second end cantilevered about the mounting for resiliently deflecting in response to external finger pressure. The cantilevered end contains an electrical contact area for making connection between electrical terminals on the mounting board when flexed in response to applied finger pressure. It is an additional feature of our invention that the electrical contact area can be arranged to selectively connect two or more electrical terminals on the mounting board.

BRIEF DESCRIPTION OF THE DRAWING

The principles of our invention as well as additional features and advantages thereof will be more fully appreciated from the illustrative embodiment shown in the drawing, in which.

DETAILED DESCRIPTION

Figure 1:
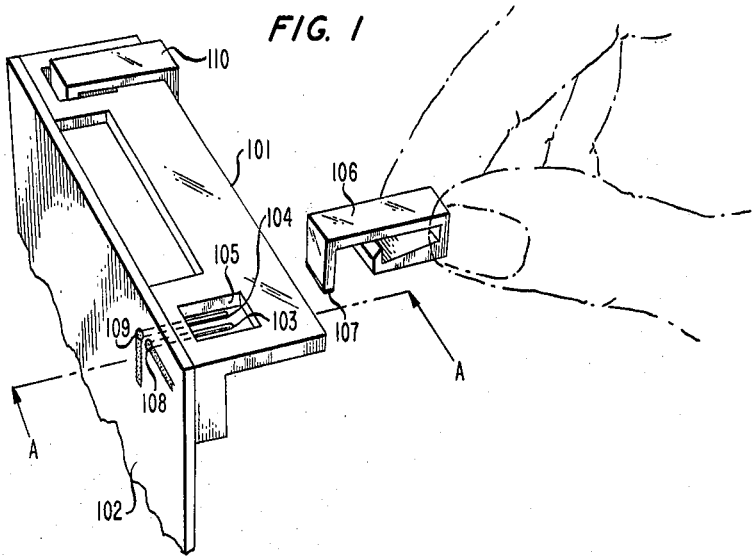
FIG. 1 shows a perspective view of the self-locking switch contact member prior to mounting on a handle.

With reference to FIG. 1, handle 101 is mounted on a printed wiring board 102 at the front edge thereof. The handle has at least one aperture 105 or slot with at least two electrical terminals 103 and 104 or posts mounted therein. These terminals 103 and 104 mount through handle 101 and are typically soldered to printed wiring paths 108 and 109 respectively to provide an electrical connection to other components on printed wiring board 102. These terminals 103 and 104 may also provide mechanical support for holding handle 101 to printed wiring board 102.

The disclosed self-locking or self-clamping switch contact member 106, shaped like a small letter "e" which is lying on its face, is constructed of a material such as Polycarbonate to permit repeated installations, removals and use over a period of years. The configuration of switch contact member 106 was designed to permit it to be constructed using well known extrusion processing techniques.

Contact 107 mounted on switch contact member 106 should be made from any of a group of well known non-oxidizing conductor materials such as Alloy 72S (copper, nickel, tin) preferably with a gold plated surface. The contact can be connected to the switch contact member by any of a number of well known techniques including heat staking, vapor deposition, double sided tape or bonding. In the preferred embodiment the contact is appliqued to the switch contact member using B. F. Goodrich's 821B adhesive.

Figure 2:
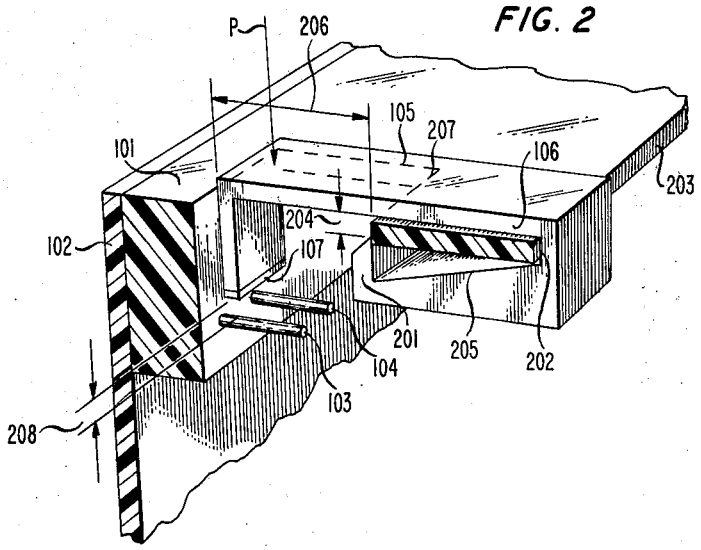
FIG. 2 shows a perspective cutaway view of the self-locking switch contact member mounted on the handle.

With reference to FIG. 2 a cutaway section A—A of FIG. 1 is shown with switch contact member 106 mounted in position on handle 101. Dimension 204 of member 106 is constructed to be less than the thickness at edge 203 of handle 101 and thus locking tab 201 is deflected downward during the sliding installation of switch contact member 106 onto handle 101. The ramp construction of locking tab 201 facilitates the deflection which occurs during the installation step. Once the open loop end of switch contact member 106 is pushed onto handle 101 such that edge 203 reaches edge 202, locking tab 201 snaps to its unstressed original position. Thus, the distance between edges 207 and 203 of handle 101 is less than the distance from locking tab 201 to edge 202 of switch contact member 106. Bias 205 insures that switch contact member 106 contacts handle 101 only at edge 202. Typically, the height of corner 202 is about 0.010 of an inch greater than the upper limit thickness of edge 203 of handle 101 to insure that locking tab 201 can snap back to its normal position when switch contact member 106 is mounted on handle 101.

When switch contact member 106 is mounted on handle 101 it appears as shown in 110 in FIG. 1. With reference to FIG. 2 a slight finger pressure P causes a slight counterclockwise rotation of member 106 until the bottom of edge 203 of handle 101 is in contact with the bottom of edge 202 of switch contact member 106. Clearance 208 between contact 107 of switch contact member 106 and terminals 103 and 104 of handle 101 is greater than the resulting rotation movement to insure no electrical connections therebetween. Additional finger pressure P causes a bending of cantilever section 206 of switch contact member 106 about the top of edge 207 of aperture 105 of handle 101. This cantilever deflection enables an electrical connection between terminals 103 and 104 of handle 101 and contact 107 of switch contact member 106. When finger pressure P is released, the resiliency of cantilever section 206 results in a self-restoring capability, thus breaking the electrical connection. Obviously, the distance of the deflection of cantilever section 206 must be selected in a well-known manner to insure no plastic deformation of cantilever section 206.

Removal of switch contact member 106 is accomplished by a downward force on locking tab 201 together with an outward force on the tab toward edge 203 of handle 101.

Figure 3:
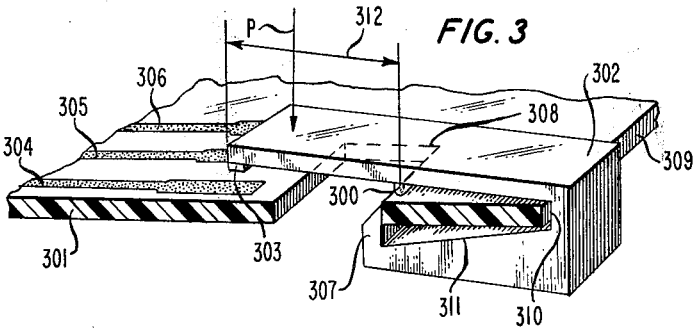
FIG. 3 shows a perspective cutaway view of another embodiment of the self-locking switch contact member mounted on a printed circuit board.

In FIG. 3 a cutaway view of another switch contact member embodiment 302, is shown mounted on printed circuit board 301. Printed circuit board 301 has an edge 309 and an aperture 308 for receiving the locking tab 307 in a manner as previously described in FIG. 2. Switch contact member 302 contains an edge 310, cantilever section 312 and a fulcrum point 300 which prevents electrical contact between its contact 303 and printed circuit paths 304, 305 and 306 on printed circuit board 301. When finger pressure P is applied, switch contact member 302 deflects and electrical connection results between contact 303 and printed circuit paths 304, 305 and 306 in a manner similar to that previously described in FIG. 2.

It is to be noted that the electrical connection made by contact 107 of FIG. 2 and contact 303 of FIG. 3 need not be limited to shorting out adjacent terminals or printed circuit paths. For example, an appropriate contact applique could enable a connection between contacts 304 and 306 to the exclusion of contact 305. Other embodiments and applications of the disclosed switch contact member may be anticipated by those skilled in the art without deviating from the disclosed essential characteristics of our disclosed self-locking switch contact member.

We claim:

1. A switching device (106 or 302) for selectively connecting a first contact point (103 or 304) of a mounting board (101 or 301) with at least one other contact point (104 or 306) thereon, said switching device being adapted for mounting by clamping on to said mounting board between a slot (105 or 308) in said mounting board and an edge (203 or 309) of said mounting board characterized in that said switching device is constructed as a unitary resilient dielectric member including one end having an open loop, means (201, 202, 205 or 307, 310, 311) located at said open loop end of said member for clamping said member around an area of said mounting board between said slot and said edge of said mounting board, means (206 or 312) located at end opposite said loop end of said member for providing a movable cantilever about said clamping means, electrical contact means (107 or 303) fixed to the tip of said cantilever means, and said cantilever means resiliently deflectable in response to an external pressure (P) enabling said fixed electrical contact means to provide an electrical connection between said first contact point and said other contact point on said mounting board.

2. The invention of claim 1 wherein said clamping means includes a locking tab (201 or 307) on said open loop end for permitting snap-on mounting said switch member to said mounting board.

3. The invention of claim 1 wherein said electrical contact means (107 or 303) is arranged to permit other than adjacent electrical contact points to be connected together.

4. The invention of claim 1 wherein said mounting board is a handle having said slot containing electrical terminals as said contact points.

5. The invention of claim 1 wherein said mounting board is a printed wiring board and said contact points are printed wiring paths on said printing wiring board.

6. A unitary movable switch contact member (106) mountable to a handle (101) of a key telephone line circuit board, said handle including an aperture (105) containing at least two recessed electrical terminals (103, 104) therein which are electrically connected together when said switch contact member is depressed in response to external finger pressure (P)

characterized in that said switch contact member includes means for locking (201, 202, 205) including a resilient dielectric open loop member to mount said switch contact member around an area of said handle between said aperture and an edge (203) of said handle, a lever end (206) of said switch contact member cantilever extended from said locking means to enable movement into said aperture in response to pressure applied to said lever end, and electrical contact means (107) mounted on said lever end of said switch contact member to make electrical connection between said at least two recessed electrical terminals in said aperture of said handle in response to the application of said pressure.

7. The invention of claim 6 wherein said locking means includes a locking tab (201) on said open loop member for snap-on mounting said switch contact member to said handle.

8. The invention of claim 7 wherein said electrical contact means is arranged to permit other than adjacent electrical terminals in said aperture to be connected together.

* * * * *